US005176754A

United States Patent [19]

Hirzel

[11] Patent Number: 5,176,754

[45] Date of Patent: Jan. 5, 1993

[54] APPARATUS WITH DOUBLE APPLICATOR MEANS

[76] Inventor: Suzy C. Hirzel, 933 Shellwood Way, Sacramento, Calif. 95831

[21] Appl. No.: 737,443

[22] Filed: Jul. 29, 1991

Related U.S. Application Data

[63] Continuation-in-part of Ser. No. 529,517, May 29, 1990, abandoned.

[51] Int. Cl.[5] ..... B05C 17/00; B05C 17.02

[52] U.S. Cl. ..... 118/258; 15/104.94; 15/114; 15/230.11; 15/144.3; 15/144.4; 29/1.01; 118/264; 132/317; 132/318; 132/320

[58] Field of Search ..... 118/206, 217, 244, 258, 118/264; 15/104.94, 114, 118, 110, 230.11, 143 B, 144 B; 401/16, 18, 19, 21, 25, 118, 130, 261, 268; 427/428, 429; 132/293, 317, 318, 320; 29/110.5

[56] References Cited

U.S. PATENT DOCUMENTS

| | | | |
|---|---|---|---|
| D. 113,690 | 3/1939 | Tresenberg | 132/320 |
| 2,270,298 | 1/1942 | Hight | 15/118 |
| 2,653,598 | 9/1953 | Torino | 15/110 |
| 2,896,243 | 7/1959 | Schoenfield et al. | 15/118 |
| 3,085,270 | 4/1963 | Vosbikian et al. | 15/114 |
| 3,228,087 | 1/1966 | Stoddart et al. | 15/230.11 |
| 3,638,939 | 2/1972 | Langley | 15/230.11 |
| 4,191,792 | 3/1980 | Janssen | 427/428 |
| 4,528,712 | 7/1985 | Liebow | 15/118 |
| 4,731,896 | 3/1988 | De La Tour | 15/110 |
| 4,961,665 | 10/1990 | Fitjer | 401/118 |
| 4,961,733 | 10/1990 | Joseph et al. | 15/114 |

*Primary Examiner*—Michael G. Wityshyn

[57] ABSTRACT

A hand held coating apparatus is comprised of first and second applicators in one apparatus. The handle is located in between the first and second applicators. The first applicator head, located on one end of the handle, is rotatable and the second applicator head, located on the opposite end of the handle, is non-rotatable, which is stationary head. Rotatable applicator is comprised of a sleeve and a sponge cover, which are secured on a rod end. The rotatable applicator is for rapid and evenly spreading coating material. Non-rotatable applicator is for mixing, dabbing, and applying coating material in hard to reach areas. The apparatus is small enough to be flipped over with a single hand motion, which allows the user to implement each applicator individually. The apparatus can be used for coating, such as paint, art work, make-up applications, body massasge or cooking practices.

5 Claims, 3 Drawing Sheets

APPARATUS WITH DOUBLE APPLICATOR MEANS

RELATED APPLICATION

The present application is a continuation-in-part of U.S. patent application Ser. No. 07/529,517 filed May 29, 1990 and entitled "Apparatus with double Applicator means", now abandoned.

BACKGROUND OF THE INVENTION

1. Field of the Invention

This invention relates generally to a cosmetic applicator, and more particularly, two applicators in one apparatus. One applicator is rotatable and the other stationary. The apparatus has many coating purposes for small surfaces, such as applying make-up to the human face, drawing on the canvas or paint touch-up for small area.

2. Prior Art

Many varieties of cosmetic applicators have been utilized over the years. Flat, round or pointed sponge tips and many types of brushes.

We all know that the roller is great for applying liquids evenly and quickly on any generally flat surface.

Flat sponge type non-rotatable applicators such as brushes, flat or pointed sponge tip applicators have their own purposes such as reaching into corners, eyelids, etc.

Many women use flat sponges or fingers to spread the liquid foundation on their face. This non-rotatable (stationary) method of application is necessary for blending, dabbing, and applying into hard to reach areas. On the other hand, a roller would be ideal for spreading liquid foundation evenly and quickly on the larger surfaces of the face.

However both applicators do have some disadvantages. The stationary applicators are a slower process and produce an uneven texture. Since the roller rotates and its shape is round, it is harder to blend, dab or apply into hard to reach areas of the face.

By combining the roller, (rotatable) and stationary applicator (non-rotatable), the user will eliminate searching for one or the other applicators, or the back and forth changing of the applicators.

Another important factor is that the sleeve and rod end should not extend past the outer edge of the cover of the roller. Other wise, sleeve or rod end will easily scratch the skin of the face or canvas, etc.

SUMMARY OF THE INVENTION

The apparatus is comprised of two applicators in one instrument.

One of the applicators is rotatable while the others is non-rotatable. Each applicator is located at opposite ends of the handle. The handle may be constructed of one or more parts.

The handle may be flat, elongated or any other shape that will easily fit into the palm of the hand, however, a rounded handle with serrations will be desirable. Total extended handle length is less than 10". If the handle is longer than 10", the applicators might touch the face or clothing accidentally when flipping the apparatus. The rotatable applicator may be any existing roller method, however, with the present invention, the roller and sleeve have elements that snap in and out, which allows for roller applicator to be replaced.

The flat (non-rotatable) applicator may be round, square, triangle, pointed, oval, rectangular, flat, or slim, sponge or any shape of brush family. However, thickness of the brush or sponge is less than 1". The roller diameter is less than 2". The purpose of this present invention is to coat a small surface with speed and without clumsiness.

The handle, can be made of any durable material such as plastic, metal, hard rubber, or wood. The flat applicator cover can be synthetic or natural sponge/foam, felt, velvet, wool, or any absorbent and preferable washable material, and brush can be from any existing brush family. For cosmetic use, the roller cover would be best if made of latex foam/sponge, which is firm enough, absorbent, washable, and F.D.A. approved for cosmetic use. The ideal sizes of the cosmetic applicator diameter, cover included, is less than 1¼".

The roller and brush combination is especially good for spreading sesame oil on seaweed. Use of the roller in the middle area of the seaweed and the brushes at the corners, will speed the coating application.

For sanitary reasons it would be packaged in an air tight plastic container or bag.

DETAILED DESCRIPTION

FIGS. 1, 2, AND 3

Figure 1:
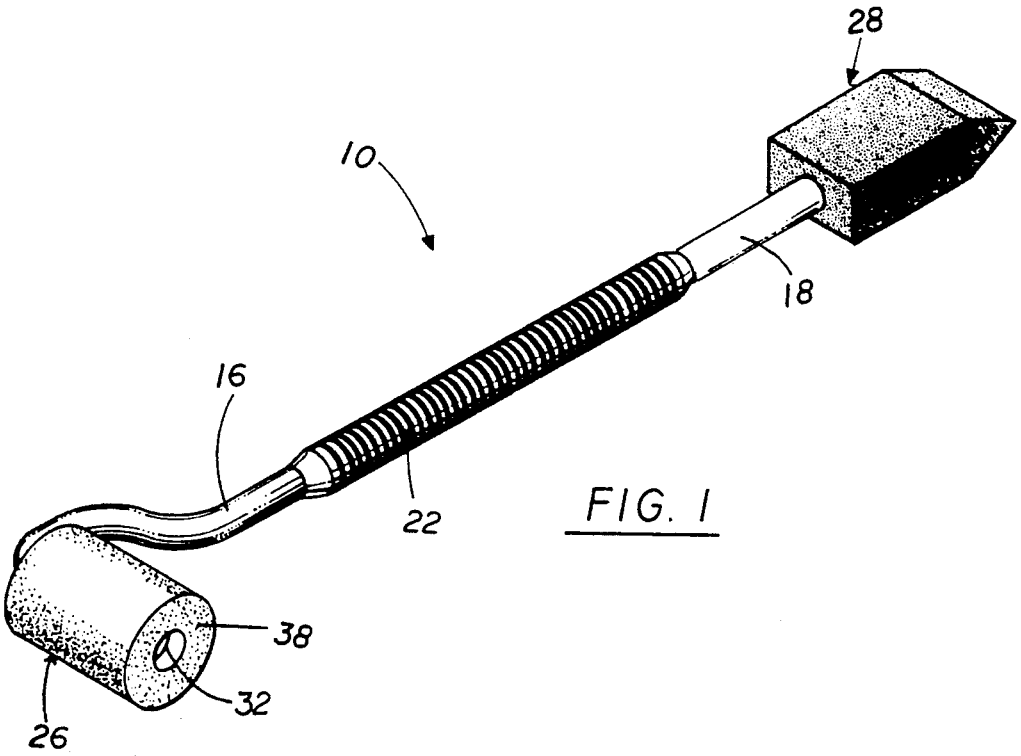
FIG. 1 is a schematic perspective top view of the first embodiment of the Double Applicator.
Figure 2:
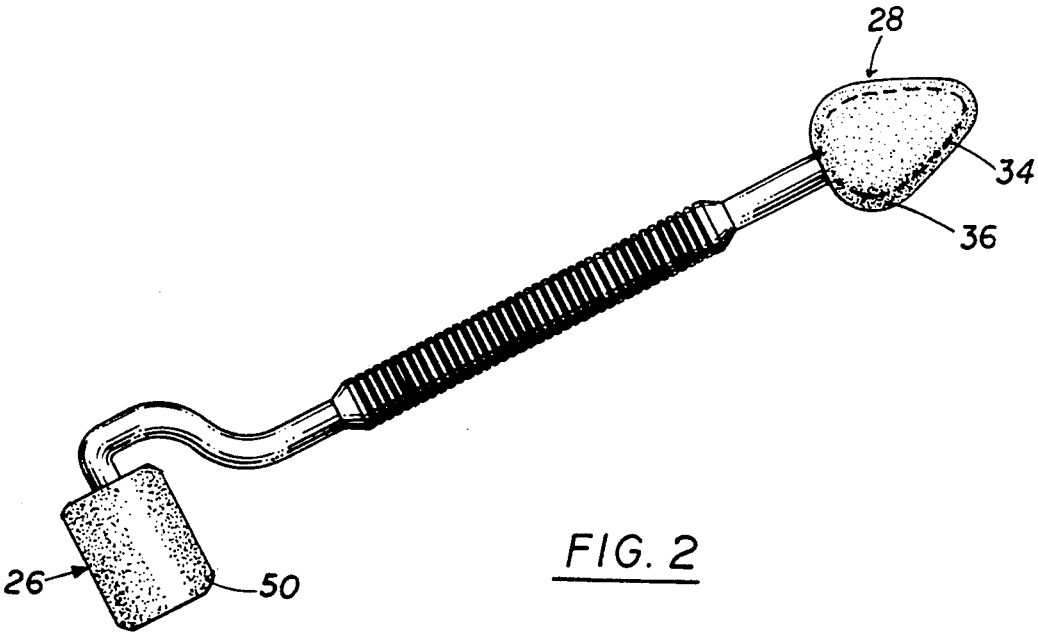
FIG. 2 is a schematic side view of the first embodiment of the Double Applicator.
Figure 3:
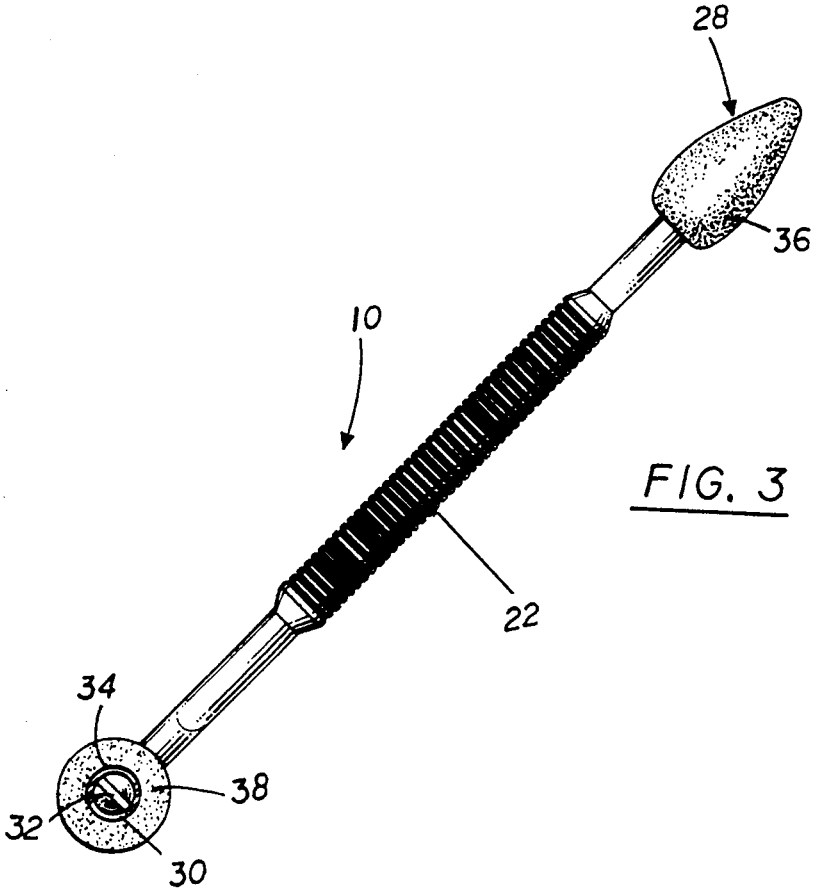
FIG. 3 is a schematic front view of the first embodiment of the Double Applicator.

Now referring more particularly to the accompanying drawings, a first preferred embodiment of the improved assembly of the present invention is schematically depicted in FIGS. 1–3. Thus, apparatus 10 is shown, which comprises generally left neck 16 and right neck 18, handle 22 and rotatable applicator 26 and non-rotatable applicator 28.

Rotatable applicator 26 is preferably a roller coater and flat non-rotatable applicator 28 is preferably sponge covered or a brush. Roller 26 is secured to the end of left neck 16, flat applicator 28 is adjacent to the end of the right neck 18.

Handle 22 is in between the necks 16 and 18. Roller 26 is comprised of sleeve 30, cover 38 and opening 34 (FIG. 3). Cover 38 may have rounded corners 50 to prevent making the sharp lines or mark when applying to surface. Cover 38 may be fat, thin, pointed in the middle or fat in the middle (not shown) or any shape to accommodate different surfaces. Flat applicator 28 is comprised of cover 36 and core 34 (FIG. 2). Flat applicator 28 can be round, rectangular, triangular, oval, pointed front and thick or thin, or any kind of shape. Core 34 is similar in shape to cover 36 but smaller. This method will make cover 36 firm enough to press against surface. However, rotatable applicator 26, and non-rotatable applicator 28 can be made of without the cover (not shown). This method can be used for massaging the various parts of the body, especially the face and hand.

The sleeve 30 length should not be any longer than the width of roller cover 38. When sleeve 30 is attached to the securing element 32 (rod end), the securing element 32 (rod end) is recessed (FIG. 1) to prevent scratching of the user's face or any other surface.

Handle 22, neck 16/18 and core 34 can be made of wood, hard rubber, metal, or plastic and can be injection molded in one piece.

Applicator covers 36/38 are generally made of absorbent material such as synthetic or natural sponge/foam, rubber, felt, fabric, fur, such as lamb's skin or a combination thereof.

Handle 22 may have non-slip cover, such as rubber, leather, plastic or similar material for easy gripping (not shown).

FIG. 4

Figure 4:
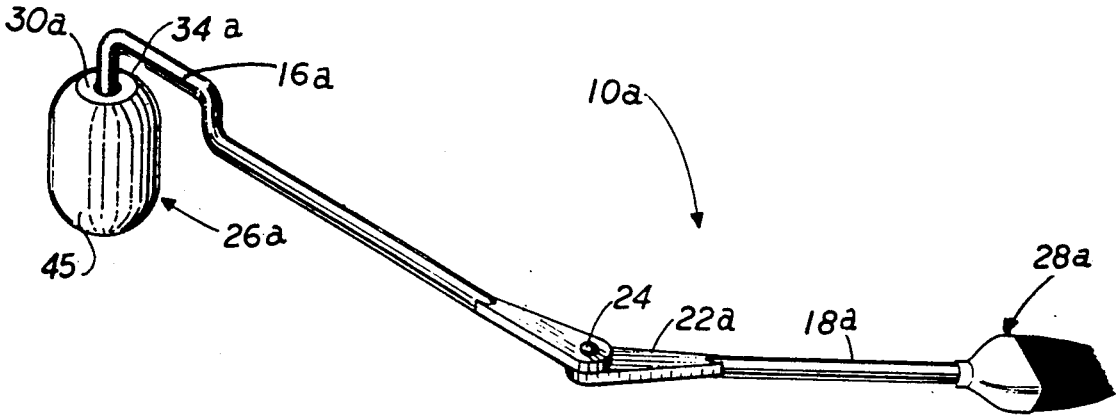
FIG. 4 is a schematic perspective side view of the second embodiment of the Double Applicator.

A second preferred embodiment of the coating Apparatus is schematically depicted in FIG. 4. Assembly 10*a* is shown. Assembly 10*a* is similar to assembly 10 and bears the same numerals, but are succeeded by the letter "a", and a new numeral is added. Assembly 10*a* is identical to assembly 10, except as follows:

Handle 22*a* is joined together by a snap lock (not shown), hinge, pin 24 or similar connecting element. This method will allow for handle to be folded for convenient storage in the container or for easy carrying and, detachable.

Roller cover 45 having only one opening 34*a*, and closed end 45 (FIG. 4) is generally rounded. This method is guaranteed not to scratch the skin or other application surfaces.

Flat applicator 28*a* (FIG. 4) is a brush.

FIGS. 5, 6, AND 7

Figure 5:
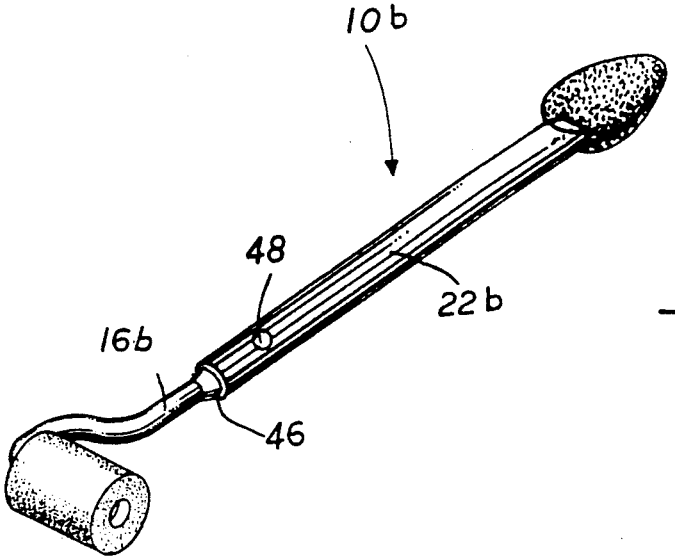
FIG. 5 is a schematic perspective side view of the third embodiment of the Double Applicator.
Figure 6:
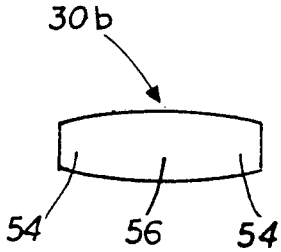
FIG. 6 is a schematic side view of the sleeve of the third embodiment of the coating Apparatus.
Figure 7:
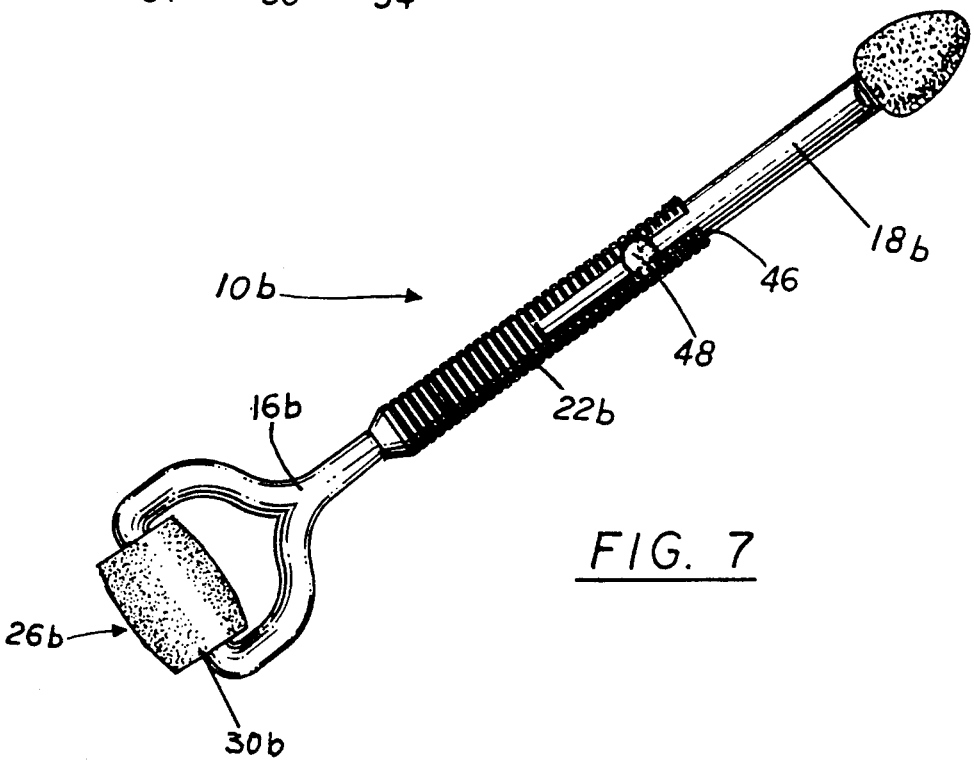
FIG. 7 is a schematic side view of the third embodiment of the Double Applicator.

A third preferred embodiment of the coating Apparatus is schematically depicted in FIGS. 5, 6, and 7. Assembly 10*b* is shown. Assembly 10*b* is similar to assembly 10 and bears the same numerals, but are succeeded by the letter "b", and a new numeral is added. Assembly 10*b* is identical to assembly 10, except as follows:

Handle 22*b* has a hollow cavity 46; hollow cavity 46 incorporates with neck 16*b* and 18*b*. Handle 22*b* may have locking element 48, which will secure the neck 16*b* or 18*b*, when they are inserted into hollow cavity 46. This method will allow the handle to extend and to store in a compact space. This method will also allow replacement of one of the applicators.

Sleeve 30*b* has a thicker middle 56, and thinner ends 54 (FIG. 6). This will result in a roller 26 having a curved surface (FIG. 7). This method will prevent marks on the skin.

Rotatable applicator 26*b* is secured by wish-bone shape rods, which are part of the neck 16*b*. This method creates a stronger neck and makes it easier to control the roller 26*b*.

Various modifications, changes, alterations and additions can be made in the double applicator of the present invention, its components and their parameters. All such modifications, changes, alterations and additions as are within the scope of the appended Claims from part of the present invention.

What is claimed is:

1. A coating applicator, comprising: an elongated member having a handle mounted thereon and applicator means mounted at each end of said member, one of said applicator means being a rotatably mounted roller and a second of said applicator means being non-rotatable, said rotatably mounted roller comprising a sleeve and a cover, wherein said cover is made of absorbent material.

2. The coating applicator of claim 1, wherein said non-rotatable applicator is a swab.

3. The coating applicator of claim 1, wherein said non-rotatable applicator is a coating brush.

4. The coating applicator of claim 1, wherein the elongated member is extendible and retractable.

5. The coating applicator of claim 1, wherein said sleeve has an outer diameter that is greater toward the middle than at either end of said sleeve.

* * * * *